United States Patent [19]

Kato et al.

[11] Patent Number: 4,883,196

[45] Date of Patent: Nov. 28, 1989

[54] HEAT-INSULATING PACKAGING BOX

[75] Inventors: Eiji Kato, Yokohama; Katsumi Kuboshima, Fuji; Tomoyuki Kaneko, Shizuoka, all of Japan

[73] Assignees: Shizuoka Prefectural Government, Shizuoka; Nihon Dimple Carton Co., Ltd., Tokyo, both of Japan

[21] Appl. No.: 243,470

[22] Filed: Sep. 12, 1988

[30] Foreign Application Priority Data

Sep. 11, 1987 [JP] Japan ..... 62-226549

[51] Int. Cl.[4] ..... B65D 1/00

[52] U.S. Cl. ..... 220/415; 220/438; 220/440; 220/901

[58] Field of Search ..... 220/438, 440, 441, 901, 220/415

[56] References Cited

U.S. PATENT DOCUMENTS

| | | | |
|---|---|---|---|
| 2,329,970 | 9/1943 | Zimmerman | 220/441 |
| 3,150,794 | 9/1964 | Schlumberger et al. | 220/440 |
| 3,344,973 | 10/1967 | Studen | 220/441 |
| 4,207,827 | 6/1980 | Gondouin | 220/901 |

*Primary Examiner*—A. Michael Chambers

*Attorney, Agent, or Firm*—Oblon, Spivak, McClelland, Maier & Neustadt

[57] ABSTRACT

A packaging box is used for packaging frozen food with an improved heat-insulating property. The movement of air surrounded by a corrugated core of a conventional corrugated card-board is interrupted, thereby enhancing the heat-insulating property. The air is prevented from permeating through the corrugated property. Further in order to improve the heat-insulating property, laminated aluminum foil is used.

24 Claims, 2 Drawing Sheets

HEAT-INSULATING PACKAGING BOX

BACKGROUND OF THE INVENTION

1. Field of the Invention

The present invention relates to a packaging box which is mainly used for packaging frozen food with an improved heat-insulating property. Also, the article according to the present invention may be used for packaging material to keep the content therein warm.

2. Description of the Prior Art

Conventionally, a box that is injection-molded of foamed polystyrene resin is used in a field in which a high heat-insulating property is needed. This box is superior in heat-insulating property but needs an individual molding die in accordance with the shape and dimension of the box. This is costly. Also, it is impossible to apply the technique to the article except for mass production. Also, since the polystyrene resin box has a large thickness and is not collapsible, there is a problem in that the spaces necessary for transportation, storage and maintenance are large. In addition, there is the situation where the lower boxes of the stacked boxes would be damaged or deformed due to their low mechanical strength.

On the other hand, a conventional corrugated card-board box is in the form of a sheet and may be transported with ease. Although corrugated card-board box needs a small space, they are insufficient in terms of heat-insulating property.

In order to overcome the above-noted defects inherent in the prior art, it is an object of the present invention to provide a heat-insulation packaging box whose required space is small, which is easy to adapt to change in configuration and dimension, which is easy to stack in sheets for transportation, storage and maintenance, which is easy to assemble for use, and which is superior in heat-insulating property to the conventional corrugated card-board box.

SUMMARY OF THE INVENTION

According to the primary feature of the present invention, the movement of air surrounded by corrugated cores of the conventional corrugated card-board is interrupted, thereby enhancing the heat-insulating property. Furthermore, the air is prevented from permeating through the corrugated card-board, thereby further improving the heat-insulating property. In addition, in order to further improve the heat-insulating property, laminated aluminum foil is used.

BRIEF DESCRIPTION OF THE DRAWINGS

The aforesaid and other objects aspects, features and attendant advantages of the present invention will become apparent from the following detailed description with reference to the accompanying drawings, which are given for the purpose of illustration alone, and in which.

The present invention will now be described in more detail.

The present inventors have conceived of the concept that for the purpose of sufficiently utilizing the heat-insulation of air existing within corrugated cores of corrugated card-board, the movement of the air existing in the corrugated cores would be interrupted by providing partitions in the central corrugated core grooves. In this case, the heat-insulating effect was confirmed by measuring it in accordance with the following method.

Figure 1:
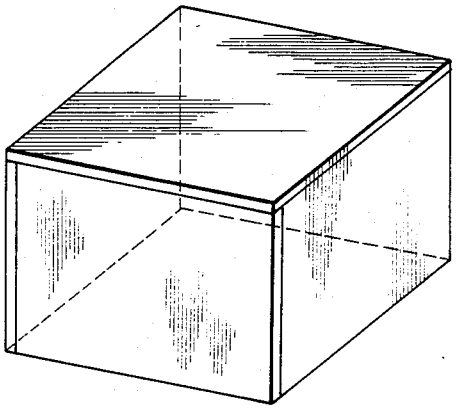
FIG. 1 is a perspective view of a box member of a heat-insulating property measurement device.
Figure 2:
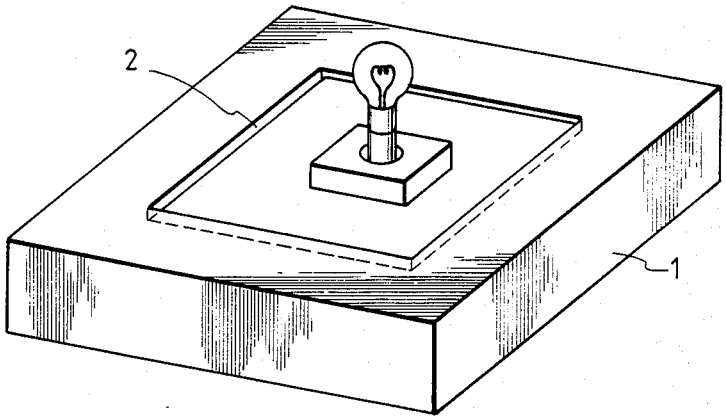
FIG. 2 is an illustration of a bottom portion of the heat-insulating property measurement device.

By using pieces of test corrugated card-board sheet having side edges of 20 cm, five-faced parallelepiped box (having no plate at only one side and formed with synthetic rubber adhesive so that each surface had a dimension of 20 cm×20 cm (see FIG. 1). An adhesive tape was attached to the connected ridge portions to prevent the leakage of air. On the bottom of the box, there was provided a block 1 made of polystyrene foam having a thickness of about 10 cm. A recess 2 having a depth of about 1 cm was formed to be engaged with the above-described parallelepiped box. A socket for a 35 W incandescent lamp was mounted on the central portion of the groove 2 so that the filament portion of the lamp was located at a height of about 7 cm from the bottom plate upper portion (see FIG. 2). Subsequently, a temperature measuring thermocouple (that was provided with a light blocking cover in order to avoid the effect of direct radiation heat from the lamp) was disposed in the vicinity of the upper corner portion of the side surface in the five-faced parallelepiped box.

Subsequently, the test corrugated card-board five-faced box was set in the recess formed in the test bottom plate so that the face having no surface plate was directed downwardly. Then, a DC stabilized electric supply source was adjusted so that the consumed electric power supplied to the incandescent lamp was kept at 25 W. At this time, the temperature within the box was measured every two seconds by the thermocouple. The temperature over a longer time period than the time in which the temperature reached a constant level was used as the box inside temperature. During this time period, of course, the consumed electric power was continuously adjusted.

The box having the high inside temperature thus measured shows a high insulating property, whereas the box having the low inside temperature shows a low insulating property.

The interval between the partitions in the corrugated cores was changed and the temperatures were measured in accordance with the foregoing test device and test method.

Figure 3:
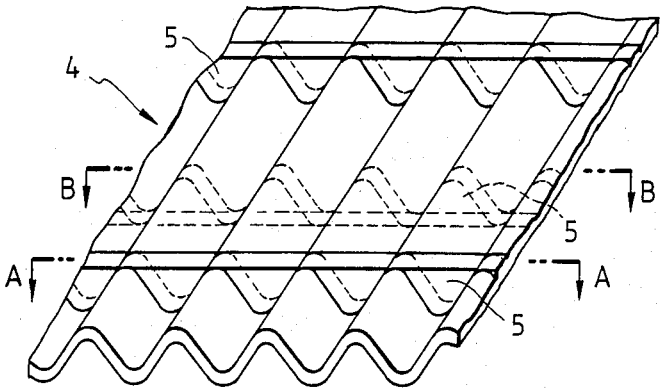
FIG. 3 is a perspective view showing a corrugated core material showing the structure of a heat-insulating package box in accordance with the present invention.
Figure 4:
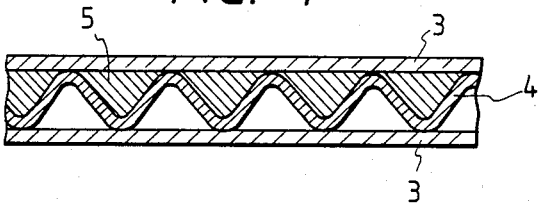
FIG. 4 is a cross-sectional view taken along the line A—A of FIG. 3, showing the heat-insulating packaging material used in the present invention.
Figure 5:
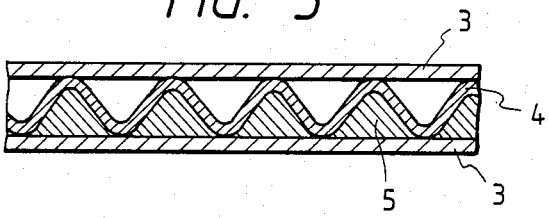
FIG. 5 is a cross-sectional view taken along the line B—B of FIG. 3, showing the heat-insulating packaging material used in the present invention.
Figure 6:
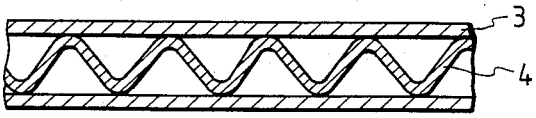
FIG. 6 is a cross-sectional view showing a conventional corrugated card-board corresponding to FIG. 4

FIG. 3 is a perspective view showing the corrugated core showing the structure of the material for the insulating packaging box in accordance with the present invention. FIG. 4 is a cross-sectional view of the insulating packaging material shown in FIG. 3, taken along the line IV—IV of FIG. 3. FIG. 5 is a cross-sectional view taken along the line V—V of FIG. 3, showing the insulating packaging material. FIG. 6 is a cross-sectional view showing the conventional corrugated card-board corresponding to FIG. 4. In these figures, reference numeral 3 denotes a liner; 4, a corrugated core liner; and 5, a partition in the form of a convex projection. Set forth below are the test results:

| Partition interval (cm) | 1 | 3 | 7 | 10 | 15 | No partition |
|---|---|---|---|---|---|---|
| Box inside temperature (°C.) | 60.4 | 60.7 | 59.5 | 58.7 | 58.4 | 57.3 |

From the results of the foregoing measurements, it was confirmed that the provision of the partitions in the corrugated core apparently enhanced the insulating effect. Also, it was found that the smaller the interval between the partitions, the slightly larger the insulating effect would become when the interval is less than 3 cm. When the interval was too small, the insulating effect was inversely lowered due to the heat transfer of the partitions. However, it is appreciated that it is most practically effective to interrupt the movement of air within the core grooves at both ends of the packaging box in view of the increment of the insulating effect and the cost increase for providing the partitions.

The above-described results were related to the partitions provided only on one side of the corrugated core. In addition, the test was conducted with respect to the case where the partitions were provided on both sides of the corrugated core. The following results were obtained.

| Partition interval (cm) | 1 | 3 | 15 |
|---|---|---|---|
| One side partition (°C.) | 60.4 | 60.7 | 58.4 |
| Both side partition (°C.) | 61.3 | 61.8 | 58.9 |

From the results, it is understood that the provision of the partitions on both sides of the corrugated core enhances the insulating property more than the provision of the partitions only one one side. Therefore, the partions should be provided on both sides but it is expected that the provision of the partitions only on one side may enhance the insulating property to a sufficient level. However, in the case were the thickness of the sheet is decreased as much as possible and at the same time, a sufficient insulating effect is needed, it is advisable to use both-side partitions. As a manner of providing the partitions, it is sufficient to provide the partitions integral with the corrugated core or otherwise it is possible to provide the separate partitions so as to be mounted on the corrugated core.

It is very advantageous in terms of cost to use a foamed plastic sheet corrugated core instead of the conventional corrugated card-board since it is very easy to work the partition portions. In addition, in this case, it was confirmed that a sufficient insulating effect was ensured.

| | Paper core | Formed resin core |
|---|---|---|
| One stage | 50 | 60 |
| Two stages | 57 | 67 |

From the above measurement results, it was found that even if the thickness was kept constant, the enhancement in insulating effect was remarkable by using the foamed core with partitions.

Subsequently, the case where in order to enhance the insulating effect, aluminum foil was attached onto one side or both sides of a piece of corrugated card-board was tested. The results were as follows.

| | No aluminum (°C.) | Aluminum (°C.) |
|---|---|---|
| General corrugated card-board (BF) | 47 | 54 (both sides) |
| General double corrugated card-board (AF + BF) | 57 | 65 (one side) |
| Foamed core partition | 60 | 78 (both sides) |
| Foamed core partition + general corrugated card-board (BF) | 64 | 82 (one side) |

From the above results, it was confirmed that the insulating effect was much enhanced in the case where the foamed partion core was used, in comparison with the case where the temperature increase was 7 to 8° C even if the aluminum layer was formed on the conventional corrugated card-board. It was found that the use of both foamed partition core and at aluminum layer considerably enhances the heat-insulating property.

The effect according to the attached position of the aluminum layer was studied. There was a slight difference in insulating effect between the case where the aluminum foil was attached on the outermost surface of the corrugated card-board and the case where the aluminum foil was attached to the back side of the outermost liner, that is, where the foil was attached in contact with the core. Therefore as a practical matter, the aluminum foil may be attached on either side of the outermost liner. It is more effective to attach the aluminum foil on the outermost surface of the corrugated card-board. However, in this case, when the packages are stacked on one another, there is a fear that the packages will slide and fall. Also, it is disadvantageous that if printing is provided on the surface, the printing costs will be increased. Therefore, it is desirable to provide the aluminum foil on the inner side of the outermost liner of the corrugated card-board.

It is possible to use an aluminum evaporation or deposition coating instead of the aluminum foil to obtain the same effect. It is also possible to use spray paint containing aluminum foil to obtain substantially the same effect. Therefore, the aluminum layer used herein generally includes these modifications.

In the case where the plastic film is attached instead of the aluminum layer, the heat-insulating effect thereof was inferior to that of the aluminum layer but was superior to that without the plastic film.

Subsequently, the case where the corrugated card-board was used in two stages (FIG. 3) was measured. In this case, it was sufficient to use the foamed partition core at least one of the corrugated card-board layers.

| | |
|---|---|
| General corrugated card-board (BF) | 46.5 °C. |
| General corrugated card-board (AF) | 50 °C. |
| General double corrugated card-board layer (AF + BF) | 57 °C. |
| Foamed partition, BF board | 64 °C. |
| Foamed partition, AF board | 74 °C. |

From the results, the two stage structure was effective.

In the case where the foamed plastic sheet was laminated on the outermost surface of the corrugated card-board, the insulating effect was further enhanced. In this case, when the packages are stacked, there is no fear that the packages would slide or fall down. Also, some shock absorbing effect is ensured. However, the printing property would be insufficient.

| | |
|---|---|
| No foamed plastic sheet | 60.7 °C. |
| Foamed plastic sheets on both sides | 78 °C. |

The articles having the following features were completed on the basis of the above-described inventive concept and their effects were confirmed by the above-described experiments.

(1) A heat-insulating packaging box is characterized in that a blocking partition is provided in grooves of corrugated core of corrugated card-board to prevent air from moving in the corrugated core.

(2) A heat-insulating packaging box as described in (1) is further characterized in that the corrugated core is made from a plastic sheet or a foamed plastic sheet.

(3) A heat-insulating packaging box as described in (1) or (2) is further characterzied in that an aluminum layer is formed on at least one of a top and a bottom at least one of the surfaces of a planar liner located on a surface of the corrugated card-board.

(4) A heat-insulating packaging box as described in (1) or (2) is further characterized in that a plastic film is attached on at least one of a top and a bottom of at least one of the surfaces of a planar liner located on a surface of the corrugated card-board.

(5) A heat-insulating packaging box as described in any one of (1) to (4) is further characterized in that a foamed partition core is used as at least cores in at least one of the cores of a two stage structure corrugated card-board.

(6) A heat-insulating packaging box as described in any one of effects (1) to (5) is further characterized in that a foamed plastic sheet is laminated on at least one surface of the outermost surfaces of the corrugated card-board.

According to the present invention, space for transportation and storage is saved, and it is possible to readily obtain a package of a desired shape and dimension with an excellent heat-insulating property.

What is claimed is:

1. A heat-insulating packaging box which comprises: a planar liner; a corrugated core of corrugated card-board having a plurality of grooves; and a plurality of blocking partitions located at spaced intervals between said core and said planar liner for preventing air from moving in the grooves of the corrugated core having said blocking partitions.

2. A heat-insulating packaging box as set forth in claim 1, wherein the corrugated core comprises a plastic sheet or foamed plastic sheet.

3. A heat-insulating packaging box as set forth in claim 2, wherein an aluminum layer is formed on one of a top and a bottom portion of at least one surface of said planar liner.

4. A heat-insulating packaging box as set forth in claim 3, wherein said corrugated core comprises a foamed partition core.

5. A heat-insulating packaging box as set forth in claim 4, which comprises a foamed plastic sheet laminated on at least one surface of an outermost liner of the corrugated card-board.

6. A heat-insulating packaging box as set forth in claim 3, which comprises a foamed plastic sheet laminated on at least one surface of an outermost liner of the corrugated card-board.

7. A heat-insulating packaging box as set forth in claim 2, wherein a plastic film is attached on one of a top and a bottom portion of at least one surface of said planar liner.

8. A heat-insulating packaging box as set forth in claim 7, wherein said corrugated core comprises a foamed partition core.

9. A heat-insulating packaging box as set forth in claim 8, which comprises a foamed plastic sheet laminated on at least one surface of an outermost liner of the corrugated card-board.

10. A heat-insulating packaging box as set forth in claim 7, which comprises a foamed plastic sheet laminated on at least one surface of an outermost liner of the corrugated card-board.

11. A heat-insulating packaging box as set forth in claim 2, wherein said corrugated core comprises a foamed partition core.

12. A heat-insulating packaging box as set forth in claim 11, which comprises a foamed plastic sheet laminated on at least one surface of an outermost liner of the corrugated card-board.

13. A heat-insulating packaging box as set forth in claim 2, which comprises a foamed plastic sheet laminated on at least one surface of an outermost liner of the corrugated card-board.

14. A heat-insulating packaging box as set forth in claim 1, wherein an aluminum layer is formed on one of a top and a bottom portion of at least one surface of said planar liner.

15. A heat-insulating packaging box as set forth in claim 14, wherein said corrugated core comprises a foamed partition core.

16. A heat-insulating packaging box as set forth in claim 15, which comprises a foamed plastic sheet laminated on at least one surface of an outermost liner of the corrugated card-board.

17. A heat-insulating packaging box as set forth in claim 14, which comprises a foamed plastic sheet laminated on at least one surface of an outermost liner of the corrugated card-board.

18. A heat-insulating packaging box as set forth in claim 1, wherein a plastic film is attached on one of a top and a bottom portion of at least one surface of said planar liner.

19. A heat-insulating packaging box as set forth in claim 18, wherein said corrugated core comprises a foamed partition core.

20. A heat-insulating packaging box as set forth in claim 19, which comprises a foamed plastic sheet laminated on at least one surface of an outermost liner of the corrugated card-board.

21. A heat-insulating packaging box as set forth in claim 18, which comprises a foamed plastic sheet laminated on at least one surface of an outermost liner of the corrugated card-board.

22. A heat-insulating packaging box as set forth in claim 1, wherein said corrugated core comprises a foamed partition core.

23. A heat-insulating packaging box as set forth in claim 22, which comprises a foamed plastic sheet laminated on at least one surface of an outermost liner of the corrugated card-board.

24. A heat-insulating packaging box as set forth in claim 1, which comprises a foamed plastic sheet laminated on at least one surface of an outermost liner of the corrugated card-board.

* * * * *